US005549063A

United States Patent [19]

Kato et al.

[11] Patent Number: 5,549,063

[45] Date of Patent: Aug. 27, 1996

[54] FRAME STRUCTURE FOR A SEWING MACHINE ARM

[75] Inventors: Shigemasa Kato; Takayuki Shiina, both of Tokyo, Japan

[73] Assignee: Juki Corporation, Tokyo, Japan

[21] Appl. No.: 498,051

[22] Filed: Jul. 5, 1995

[30] Foreign Application Priority Data

Dec. 28, 1994 [JP] Japan ..... 6-327864

[51] Int. Cl.[6] ..... D05B 73/02; D05B 71/00; F16N 31/00

[52] U.S. Cl. ..... 112/258; 112/256; 184/6.15

[58] Field of Search ..... 112/256, 258, 112/259, 43; 184/6.15

[56] References Cited

U.S. PATENT DOCUMENTS

| | | | |
|---|---|---|---|
| 2,206,285 | 7/1940 | Kaier | 112/256 |
| 2,237,273 | 4/1941 | Hacklander et al. | 184/6.15 |
| 2,386,349 | 10/1945 | Saur | 112/256 |
| 2,762,324 | 9/1956 | Hess | 112/256 |
| 4,046,368 | 8/1977 | Marforio | 112/258 |

*Primary Examiner*—C. D. Crowder
*Assistant Examiner*—Ismael Izaguirre
*Attorney, Agent, or Firm*—Morgan, Lewis and Bockius LLP

[57] ABSTRACT

A sewing machine having a substantially U-shaped structure includes a bed section, a barrel section connected to the bed section in a substantially perpendicular fashion, and a bracket connected to the arm barrel section in a substantially perpendicular fashion and extended substantially parallel to the bed section. The bracket includes an opening at an upper surface of the bracket and an arm cover engageable with the upper surface of the bracket for closing the arm opening. The arm cover is substantially flush with the upper surface of the bracket when engaged with the upper surface.

22 Claims, 3 Drawing Sheets

FRAME STRUCTURE FOR A SEWING MACHINE ARM

BACKGROUND OF THE INVENTION

1. Field of the Invention

This invention relates to a sewing machine structure and, more particularly, to a sewing machine structure that prevents oil inside the sewing machine from leaking out onto a cloth that is being sewed.

2. Description of the Related Art

In general, as shown in FIG. 5, an arm 1 of a lock stitching type sewing machine (hereinafter referred to as "a sewing-machine arm") has an opening 2, which is closed with an arm cover 3. By removing the arm cover 3 to expose the inside of the sewing-machine arm, it is possible to repair the interior of the sewing machine with ease and high efficiency.

A number of high-speed components are located inside the sewing-machine arm 1. When those components operate, oil on those components is scattered about. If the sewing-machine arm 1 is not suitably closed with the arm cover 3, as shown in FIG. 6, oil O in the sewing-machine arm 1 may leak out through the gap between the sewing-machine arm 1 and the arm cover 3 and stain a piece of cloth being sewed. To solve this problem, a packing material 4 is typically set between the sewing-machine arm 1 and the arm cover 3 to sufficiently seal the opening of the arm 1 and prevent the oil in the sewing-machine arm 1 from leaking out as shown in FIGS. 5 and 7.

However, as described above, the arm cover 3 is detachably engaged with the sewing-machine arm 1. Hence, as the arm cover 3 is repeatedly engaged with and disengaged from the sewing-machine arm 1, the packing material 4 gradually deteriorates, and eventually requires replacement. Moreover, the configuration of the packing material 4 depends on the sewing machine; that is, different sewing machines have different packing materials 4, which makes the maintenance of sewing machines rather troublesome.

SUMMARY OF THE INVENTION

The present invention has been made in view of the above circumstances and has as an object overcoming the disadvantages of the prior art devices.

A further object of the present invention is to provide a frame structure of an arm of a sewing machine that prevents the oil in the arm from leaking out through the opening of the arm without using a packing material.

Additional objects and advantages of the invention will be set forth in part in the description which follows and, in part, will be obvious from the description or, may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, and in order to solve the above-described problem, a sewing machine having a substantially U-shaped structure comprises a bed section; a barrel section connected to the bed section in a substantially perpendicular fashion; and a bracket connected to the arm barrel section in a substantially perpendicular fashion and extended substantially parallel to the bed section, the bracket including an opening at an upper surface of the bracket and an arm cover engageable with the upper surface of the bracket for closing the arm opening, the arm cover being substantially flush with the upper surface of the bracket when engaged with the upper surface.

In another aspect of the present invention, a bracket of a sewing machine comprises a plurality of surfaces including an upper surface having an opening; and an arm cover engageable with the upper surface of the bracket for closing the arm opening, the arm cover being substantially flush with the upper surface of the bracket when engaged with the upper surface.

In another aspect of the present invention, a frame structure of an arm of a sewing machine having a substantially U-shape comprises a first upper end face having an upward opening with a periphery; and an arm cover having a second upper end face and an outer periphery for closing the opening with the second upper end face of the arm cover, the second upper end face of the arm cover being substantially flush with the first upper end face.

In a further aspect of the present invention, a bracket of a sewing machine comprises a plurality of surfaces including an upper surface having an opening; an arm cover engageable with the upper surface of the bracket for closing the arm opening; and a predetermined gap between the arm cover and the bracket.

BRIEF DESCRIPTION OF THE DRAWINGS

The accompanying drawings that are incorporated in and constitute a part of this specification, illustrate embodiments of the invention and, together with the description, serve to explain the objects, advantages, and principles of the invention.

In the drawings.

DETAILED DESCRIPTION OF THE PREFERRED EMBODIMENTS

The present invention includes a sewing machine having an arm, the frame structure of which is substantially U-shaped. An opening is formed in an upper end face of the arm in an upward direction, and an arm cover is provided for covering the opening such that an upper end face of the arm cover is flush with the upper end face of the arm.

In the frame structure, the periphery of the opening in the arm has a supporting surface to which an outer periphery of the arm cover is engaged. A rising portion extends upwardly from the supporting surface such that a predetermined gap is formed between the rising portion and the outer periphery of the arm cover. The opening is formed at least at an inner edge of the upper end face of the arm.

With the frame structure as described in the above paragraphs, if oil inside the arm of the sewing machine flows into the gap between the arm and the arm cover, the rising portion of the arm prevents the oil from leaking out of the arm. Moreover, because the predetermined gap is sufficiently wide, the oil cannot seep out by capillary action, for example. Thus, oil leakage out of the arm can be more effectively prevented, and the simple design of the present invention reduces manufacturing cost and improves manufacturing efficiency.

Now, the preferred embodiments of the invention will be described with reference to the accompanying drawings.

Figure 1:
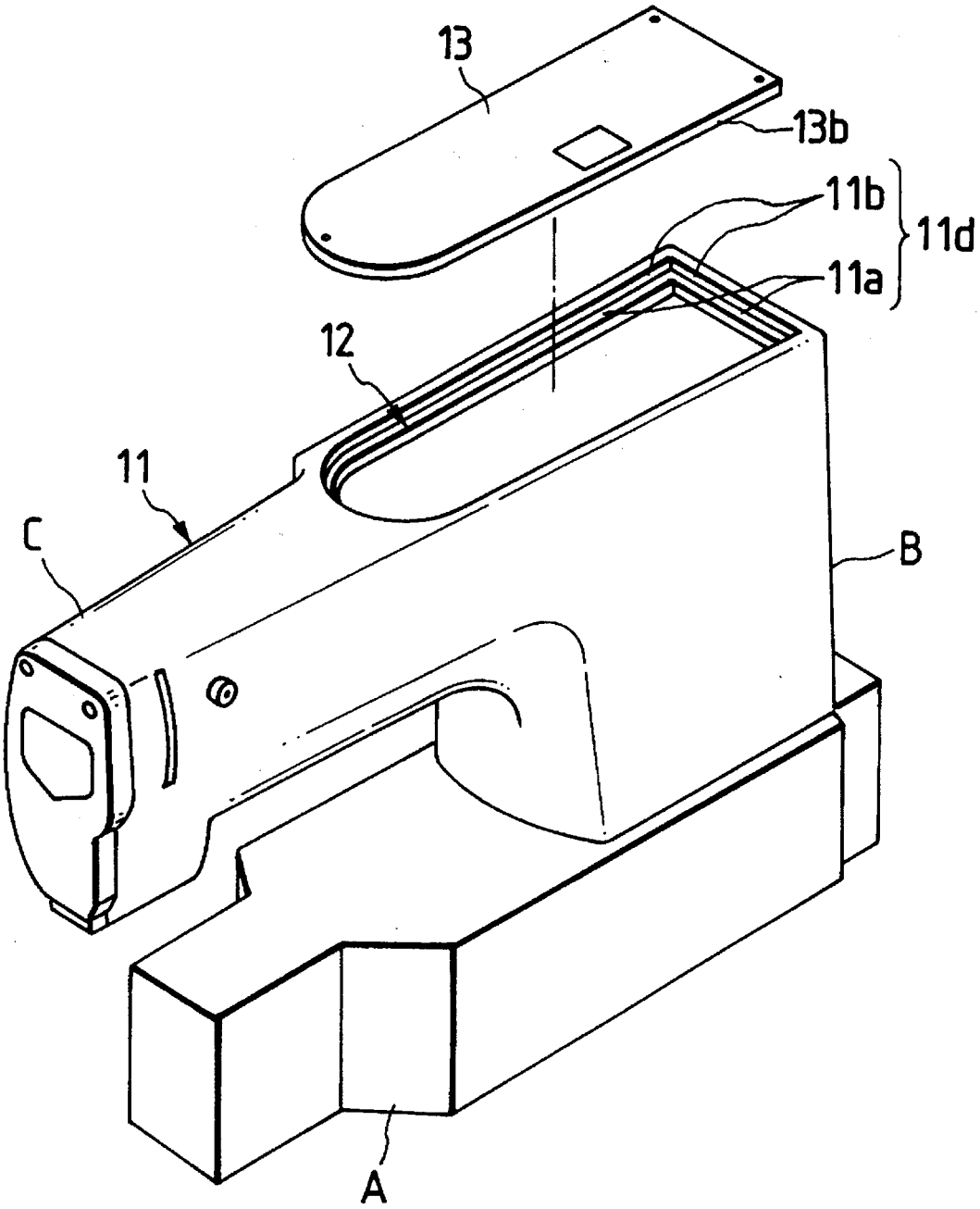
FIG. 1 is an exploded perspective view showing a sewing-machine arm and an arm cover in an embodiment of the invention.
Figure 2:
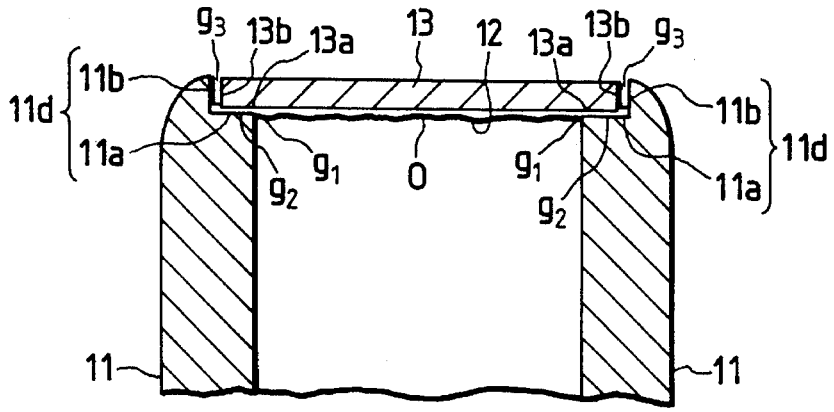
FIG. 2 is a vertical sectional view of the sewing-machine arm and the arm cover in the embodiment shown in FIG. 1.

FIGS. 1 and 2 show a first embodiment of the invention. In FIGS. 1 and 2, the sewing machine of the present invention comprises a bed section A, a standard B, and a bracket C. Reference numeral 11 designates the arm of the sewing machine. An opening 12 is formed at the upper surface of the bracket C to allow repair and adjustment of relevant components inside the bracket C. The opening 12 is formed by cutting an inner edge portion of the upper end face of the arm (a frame). Hence, a periphery of the opening 12 is a fitting groove 11*d* with an L-shape having a horizontal support surface 11*a* and a vertical surface 11*b* (or a rising portion). The rising portion 11*b* extends vertically from the support surface 11*a*.

Reference numeral 13 of FIGS. 1 and 2 designates an arm cover used to close the opening 12. The arm cover 13 is in the form of a flat plate whose periphery engages with the fitting groove 11*d* to close the opening 12. The area of the arm cover 13 is slightly smaller than the area that is defined by the vertical surface 11*b*. When the arm cover 13 engages with the fitting groove 11*d*, the lower surface 13*a* of the peripheral portion of the arm cover 13 becomes supported by the support surface 11*a*. The upper surface of the arm cover 13 becomes flush with the upper surface of the sewing-machine arm, and the peripheral surface 13*b* of the arm cover 13 confronts the vertical surface 11*b* with a predetermined gap g3 between them.

During operation of the sewing machine having the above-described oil leakage structure, oil O is sprayed inside the sewing machine arm 11 onto the inner surface of the sewing machine arm including an edge portion g1 of the sewing-machine arm 11. Because the arm cover 13 is in contact with the horizontal support surface 11*a* of the fitting groove 11*d*, the oil flows into the gap g2 between the arm cover 13 and the horizontal support surface 11*a*. However, the oil flow is stopped when the oil O reaches the gap g3 between the peripheral surface 13*b* of the arm cover 13 and the vertical surface 11*b* of the fitting groove 11*d*. Since the gap g3 is extended vertically, when the upward movement of the oil reaches the lower end of the gap g3, the oil is stopped by its own weight (gravity). Thus, the oil O is prevented from leaking out of the sewing-machine arm 11.

If the gap g3 is extremely small, however, then the oil may go up the gap g3 by capillary action. Hence, in the present embodiment, the gap g3 has a certain width so that the oil O is prevented from flowing up the gap g3.

In the above-described embodiment, the vertical surface 11*b* of the sewing-machine arm 11 and the peripheral surface 13*b* of the arm cover 13 prevent the leakage of oil. Moreover, no packing material is required which, in the prior art, is set between the sewing-machine arm and the arm cover to close the gap between them. The manufacturing cost of the sewing machine according to the present invention is less than a conventional sewing machine. Furthermore, the arm cover of the present invention is simple in configuration and structure and can therefore be formed with ease.

Figure 3:
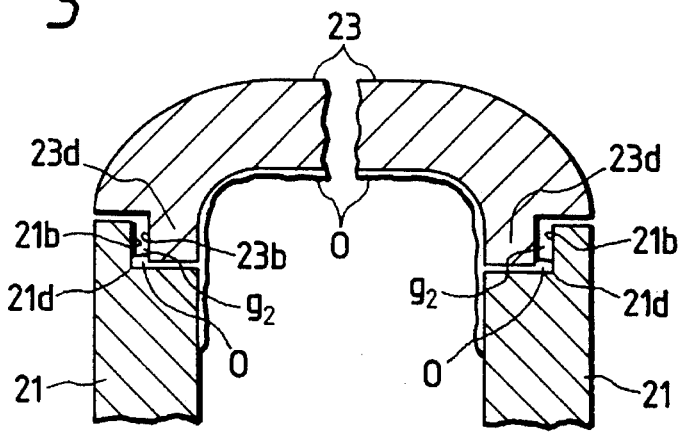
FIG. 3 is a vertical sectional view showing a sewing-machine arm and an arm cover in another embodiment of the invention.

Additionally, the present invention is applicable to a sewing machine in which the arm cover is not in the form of a flat plate. That is, the invention is not limited to the above-described embodiment. For instance, in the case where a sewing machine has an arm cover whose peripheral portion is curved, the sewing-machine arm and the arm cover may be formed as shown in FIG. 3. In particular, a flange 23*d* (or a rising portion) is formed on the lower end faces of the arm cover 23, and a groove 21*d*, engageable with a corresponding flange 23*d*, is formed at the upper end face of the sewing-machine arm 21 such that a predetermined gap g2 is formed between the side surface 23*b* of the flange 23*d* and the side surface 21*b* of the groove 21*d*. This structure has the same advantages as discussed in the first embodiment.

Figure 4:
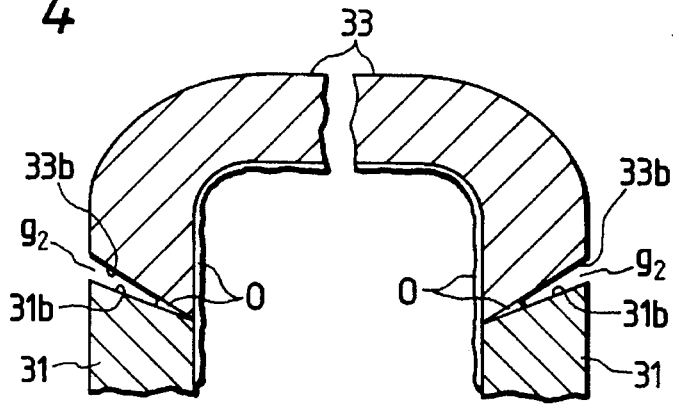
FIG. 4 is a vertical sectional view showing a sewing-machine arm and an arm cover in another embodiment of the invention.
Figure 5:
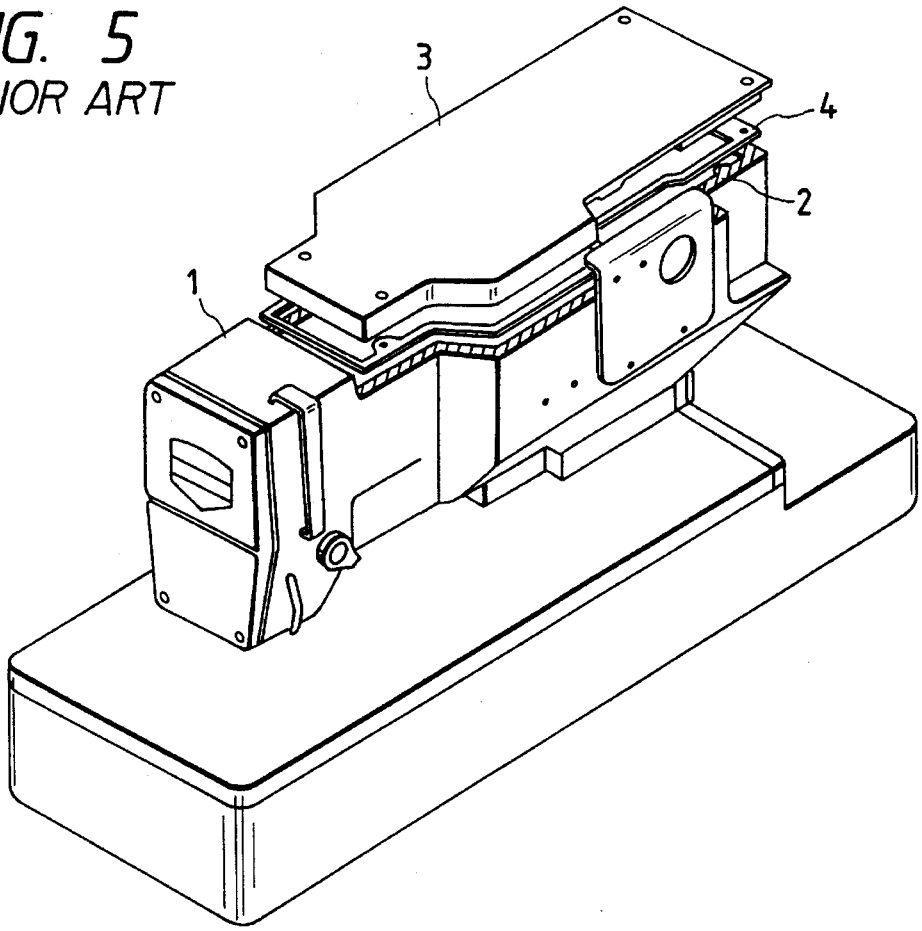
FIG. 5 PRIOR ART
FIG. 5 is an exploded perspective view showing a sewing-machine arm and an arm cover in a conventional sewing machine.
Figure 6:
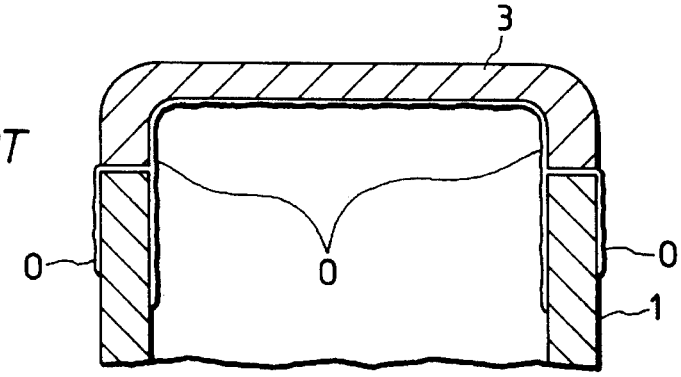
FIG. 6 PRIOR ART
FIG. 6 is a vertical sectional view illustrating a leakage of oil in the case where the arm cover shown in FIG. 5 is engaged with the sewing-machine arm without a packing material.
Figure 7:
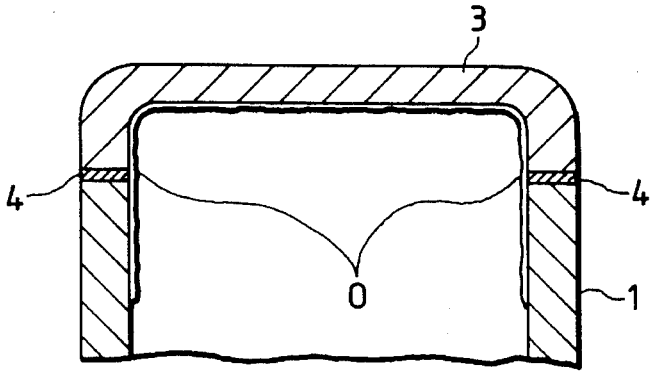
FIG. 7 PRIOR ART
FIG. 7 is a vertical sectional view illustrating a leakage of oil in the case where the arm cover shown in FIG. 5 is engaged with the sewing-machine arm through a packing material.

In another embodiment of the present invention, the sewing-machine arm and the arm cover may be formed, as shown in FIG. 4. An upper surface 31*b* of the sewing-machine arm 31 is formed as a sloped surface (or a rising portion) which is inclined upward and outward. A lower end surface 33*b* of the arm cover 33 is formed as a sloped surface which is inclined downward and inward so that, when the arm cover 33 engages the sewing-machine arm, the lower end face 33*b* and the upper surface 31*b* form a gap g2. This structure also has the same advantages as discussed in the above-described embodiment. The gap g2 formed between the lower end face 33*b* and the upper surface 31*b* is wedge-shaped in section and expands both outward and upward. Even if oil O leaks into the gap g2, the weight of the oil (gravity) prevents the oil from moving up the gap. Thus, the leakage of oil out of the sewing-machine arm is prevented. Also in this structure, the gap g2 should be sufficiently wide so as to lessen the effect of capillary action.

The arm of the sewing machine of the present invention has the above-described frame structure. Accordingly, during the operation of the sewing machine, even if oil sprayed inside the arm reaches the gap between the arm and the arm cover, the rising portion provided at the junction of the arm and the arm cover stops the flow of the oil. Therefore, the leakage of oil out of the arm is prevented without adding a packing material between the arm and the arm cover. Accordingly, the sewing machine of the present invention is less costly to manufacture than a conventional sewing machine which must employ a packing material.

In addition, the arm cover described in the present invention can be readily engaged and disengaged with the sewing-machine arm. The gap between the rising portion and the surface confronting the rising portion prevents the oil from flowing up the rising portion by capillary action. Thus, the present invention better ensures that oil leakage out of the sewing-machine arm is prevented.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sewing machine having a substantially U-shaped structure comprising:

a bed section;

a barrel section connected to the bed section in a substantially perpendicular fashion;

a bracket connected to the barrel section in a substantially perpendicular fashion and extended substantially parallel to the bed section, the bracket including an arm opening at an upper surface of the bracket and an arm cover engageable with the upper surface of the bracket for closing the arm opening, the arm cover being substantially flush with the upper surface of the bracket when engaged with the upper surface, the arm opening having a periphery including a support surface for engaging the arm cover and a rising portion extending upward from the support surface; and a predetermined gap between the rising portion of the arm opening and an outer periphery of the arm cover when the arm cover is positioned in the arm opening, the predetermined gap extending continuously along an entire length of the rising portion of the arm opening opposite the arm cover outer periphery.

2. The sewing machine according to claim 1, wherein the predetermined gap is large enough to prevent oil from leaking out onto an outer surface of the bracket.

3. The sewing machine according to claim 1, wherein the upper surface of the bracket has an inner edge portion and the arm opening is formed at the inner edge portion.

4. The sewing machine according to claim 1, wherein the rising portion extends substantially perpendicular relative to the support surface.

5. The sewing machine according to claim 1, wherein the gap is wedge-shaped in section.

6. A bracket of a sewing machine comprising:

a plurality of surfaces including an upper surface having an arm opening, the arm opening having a periphery including a support surface for engaging the arm cover and a rising portion extending upward from the support surface;

an arm cover engageable with the upper surface of the bracket for closing the arm opening, the arm cover being substantially flush with the upper surface of the bracket when engaged with the upper surface; and a predetermined gap between the rising portion of the arm opening and an outer periphery of the arm cover when the arm cover is positioned in the arm opening, the predetermined gap extending continuously along an entire length of the rising portion of the arm opening opposite the arm cover outer periphery.

7. The bracket of a sewing machine according to claim 6, wherein the predetermined gap is large enough to prevent oil from leaking out onto an outer surface of the bracket.

8. The bracket of a sewing machine according to claim 6, wherein the upper surface of the bracket has an inner edge portion and the arm opening is formed at the inner edge portion.

9. The bracket of a sewing machine according to claim 6, wherein the rising portion extends substantially perpendicular relative to the support surface.

10. The bracket of a sewing machine according to claim 6, wherein the gap is wedge-shaped in section.

11. A frame structure of an arm of a sewing machine having a substantially U-shape comprising:

a first upper end face having an arm opening with a periphery, the periphery of the opening of the arm including a support surface for engaging the outer periphery of the arm cover and a rising portion extending upward from the support surface;

an arm cover having a second upper end face and an outer periphery for closing the opening with the second upper end face of the arm cover, the second upper end face of the arm cover being substantially flush with the first upper end face; and a predetermined gap between the rising portion and an outer periphery of the arm cover, the predetermined gap extending continuously along an entire length of the rising portion of the arm opening opposite the arm cover outer periphery.

12. The frame structure according to claim 11, wherein the predetermined gap is large enough to prevent oil from leaking out onto an outer surface of the arm.

13. The frame structure according to claim 11, wherein the opening is formed at least at an inner edge of the upper end face of the arm.

14. The frame structure according to claim 11, wherein the rising portion extends substantially perpendicular relative to the support surface.

15. The frame structure according to claim 11, wherein the gap is wedge-shaped in section.

16. A bracket of a sewing machine comprising:

a plurality of surfaces including an upper surface having an arm opening, the arm opening having a periphery including a support surface and a rising portion extending upward from the support surface;

an arm cover engageable with the support surface of the bracket for closing the arm opening; and a predetermined gap disposed between the rising portion of the arm opening and an outer periphery of the arm cover when the arm cover is positioned in the arm opening, the predetermined gap extending continuously along an entire length of the rising portion of the arm opening opposite the arm cover outer periphery.

17. The bracket of a sewing machine according to claim 16, wherein the predetermined gap is large enough to prevent oil form leaking out onto an outer surface of the bracket.

18. The bracket of a sewing machine according to claim 16, wherein the upper surface of the bracket has an inner edge portion and the arm opening is formed at the inner edge portion.

19. The bracket of a sewing machine according to claim 16, wherein the rising portion extends substantially perpendicular relative to the support surface.

20. The bracket of a sewing machine according to claim 16, wherein the gap is wedge-shaped in section.

21. A sewing machine frame structure including a bed, a standard raised from the bed, and a bracket extended from the standard and having an arm, the sewing machine frame structure comprising:

an opening formed in the bracket at its top;

an arm cover configured to fit flush with the arm; and seal means for securing the cover to the bracket to engage the cover with the opening, the seal means including a predetermined gap extending continuously along an entire length of a rising portion of the opening opposite an outer periphery of the arm cover.

22. A sewing machine having a substantially U-shaped structure comprising:

a bed section;

a barrel section connected to the bed section in a substantially perpendicular fashion; and a bracket connected to the barrel section in a substantially perpendicular fashion and extended substantially parallel to the bed section, the bracket including an arm opening at an upper surface of the bracket and an arm cover engageable with the upper surface of the bracket for closing the arm opening, the arm cover being substantially flush with the upper surface of the bracket when engaged with the upper surface, the arm opening having a periphery including a support surface for engaging the arm cover and a rising portion extending upward from the support surface and continuously along the entire periphery of the arm opening opposite an outer periphery of the arm cover.

* * * * *

UNITED STATES PATENT AND TRADEMARK OFFICE

CERTIFICATE OF CORRECTION

PATENT NO. : 5,549,063

DATED : August 27, 1996

INVENTOR(S) : Shigemasa KATO et al.

It is certified that error appears in the above-indentified patent and that said Letters Patent is hereby corrected as shown below:

COLUMN 6:

Line 45, "form" should be --from--.

Signed and Sealed this

Ninth Day of September, 1997

*Attest:*

*Attesting Officer*

BRUCE LEHMAN

*Commissioner of Patents and Trademarks*